US005970699A

United States Patent [19]

Grässle et al.

[11] Patent Number: 5,970,699

[45] Date of Patent: Oct. 26, 1999

[54] ROVING FRAME WITH BOBBIN CHANGING DEVICE

[75] Inventors: Herbert Grässle, Schwäbisch-Gmünd/Metlangen; Hans-Peter Weeger, Hattenhofen, both of Germany

[73] Assignee: Zinser Textilmaschinen GmbH, Ebersbach/Fils, Germany

[21] Appl. No.: 09/029,562

[22] PCT Filed: Jul. 8, 1997

[86] PCT No.: PCT/DE97/01486

§ 371 Date: Mar. 2, 1998

§ 102(e) Date: Mar. 2, 1998

[87] PCT Pub. No.: WO98/05810

PCT Pub. Date: Feb. 12, 1998

[30] Foreign Application Priority Data

Aug. 3, 1996 [DE] Germany ..... 196 31 445

[51] Int. Cl.[6] ..... D01H 9/10

[52] U.S. Cl. ..... 57/281; 57/90; 57/267; 57/270

[58] Field of Search ..... 57/281, 267, 270, 57/90, 274, 136; 19/159 A

[56] References Cited

U.S. PATENT DOCUMENTS

| | | | |
|---|---|---|---|
| 4,934,132 | 6/1990 | Marzoli | 57/267 |
| 5,222,350 | 6/1993 | Bowman et al. . | |
| 5,375,405 | 12/1994 | Weeger | 57/281 |
| 5,522,210 | 6/1996 | Mack | 57/281 |
| 5,697,205 | 12/1997 | Mack | 57/281 X |
| 5,797,255 | 8/1998 | Saito et al. | 57/281 |

FOREIGN PATENT DOCUMENTS

| | | |
|---|---|---|
| 0 214 837 A2 | 3/1987 | European Pat. Off. . |
| 0 310 568 B1 | 4/1989 | European Pat. Off. . |
| 39 36 518 A1 | 5/1991 | Germany . |
| 39 36 518 A1 | 8/1991 | Germany . |
| 44 36 277 A1 | 4/1995 | Germany . |
| 04352824 | 12/1992 | Japan . |

*Primary Examiner*—William Stryjewski
*Assistant Examiner*—Gina Silverio
*Attorney, Agent, or Firm*—Herbert Dubno

[57] ABSTRACT

In order to quickly exchange empty sleeves (18) for full bobbins (6)in a roving frame, guiding rails (14, 21, 22) are mounted along at least one row of flyers (4). A suspended carriage train (15) with hangers (16) can be driven on the guiding rails (14, 21, 22). By lifting and lowering the bobbin rail (5), the bobbins (6) can be transferred from the bobbin rail (5) to the hangers (16) of the suspended carriage train (15) and sleeves (18) can be moved from the hangers to the bobbin rail. The bobbin rail (5) and/or the guiding rails (14, 21, 22) can be moved back and forth. Fixed guiding rails (14) can rest on the bottom side of the flyer rail (3), and movable guiding rails (21, 22) are arranged in the area below the flyers (4). Such guiding rails may be designed to slide or swivel.

6 Claims, 10 Drawing Sheets

ROVING FRAME WITH BOBBIN CHANGING DEVICE

CROSS REFERENCE TO RELATED APPLICATIONS

This application is a national stage of PCT/DE97/01486 filed Jul. 8, 1997 and is based, in turn, on German national application 196 31 445.3 of Aug. 3, 1996.

1. Field of the Invention

The invention relates to a roving machine with at least one row of flyers journaled on a flyer rail and with a device for the automatic replacement of full roving bobbins by empty roving sleeves in the form of a suspension trolley carriage with hangers that is displaced on guide means and on which the roving bobbins and roving tubes can be hung by a relative vertical movement between the roving bobbins and the suspension trolley train.

2. Background of the Invention

A bobbin replacement system is known from DE 42 29 296 A. The arrangement of the guide tracks within the flyers means that the guide track must be subdivided into short segments corresponding to the spacing of the flyers and which must be swingable so that they can be brought outside of the rotary paths of the flyers during the operation thereof. This calls for expensive construction. After the roving machine is brought to standstill and before it is turned on again, these segments must form the guide track and be separated again before the suspension trolley carriage can be fed into the flyers and before the roving machine can be turned on again. This requires waiting times and increases the standstill period of the roving machine.

OBJECT OF THE INVENTION

The invention has as its object a simpler arrangement of the guide tracks.

SUMMARY OF THE INVENTION

In one aspect of the invention the guide tracks preferably are arranged on the underside of the flyer rail. This has the advantage that the guide tracks can be fixedly arranged. However, this arrangement requires taking up the roving bobbins or roving tubes in the bobbin rail of the roving machine by the guide rails which are arranged between the rows of flyers and bringing them into a common vertical plane. It is customary to provide the bobbin rail so that it is movable by a corresponding stretch. It is however also possible to form the flyer rail or both units so that they are shiftable.

The embodiment according to claim 4 has the advantage both the guide track and also the flyer rail can be fixedly arranged and the bobbin rail need not be shiftable back and forth. For this however, the guide track must be movable.

The guide tracks can be shiftable linearly out of the machine stand. They can however also be shiftable along the longitudinal axis of the roving machine, whereby with two guide tracks one axis lies along the axis of the machine stand while the other lies at the front side of the roving machine.

In all cases with roving machines equipped with two rows of flyers, one of the guide tracks lies between the flyer rows while the other lies ahead or behind the flyer rows with reference to the front side of the machine. Correspondingly the bobbin rail or the guide tracks upon bobbin replacement must be shiftable forwardly or rearwardly.

The shifting of the bobbin rails can be effected by mounting the bobbin rails so that they are guided horizontally on traverses which can be movable up and down to raise and lower the bobbin rail during the building of the bobbins and on which the bobbin rail can be shiftable forwardly and back. Because the rotary drive is transmitted to the bobbin carriers in the bobbin rail in all cases without articulated shafts, the additional mobility of the bobbin rail does not pose any structural problems.

The bobbins in all cases are driven by spindles which are arranged on the bobbin rail as bobbin spindles. In the embodiment with the guide tracks fed from below the flyers it is advantageous to bring the spindles into the flyers, i.e. to form them as flyer spindles. This can provide a saving in the height of the construction.

BRIEF DESCRIPTION OF THE DRAWING

The above and other objects, features, and advantages will become more readily apparent from the following description, reference being made to the accompanying drawing in which.

Figure 1A:
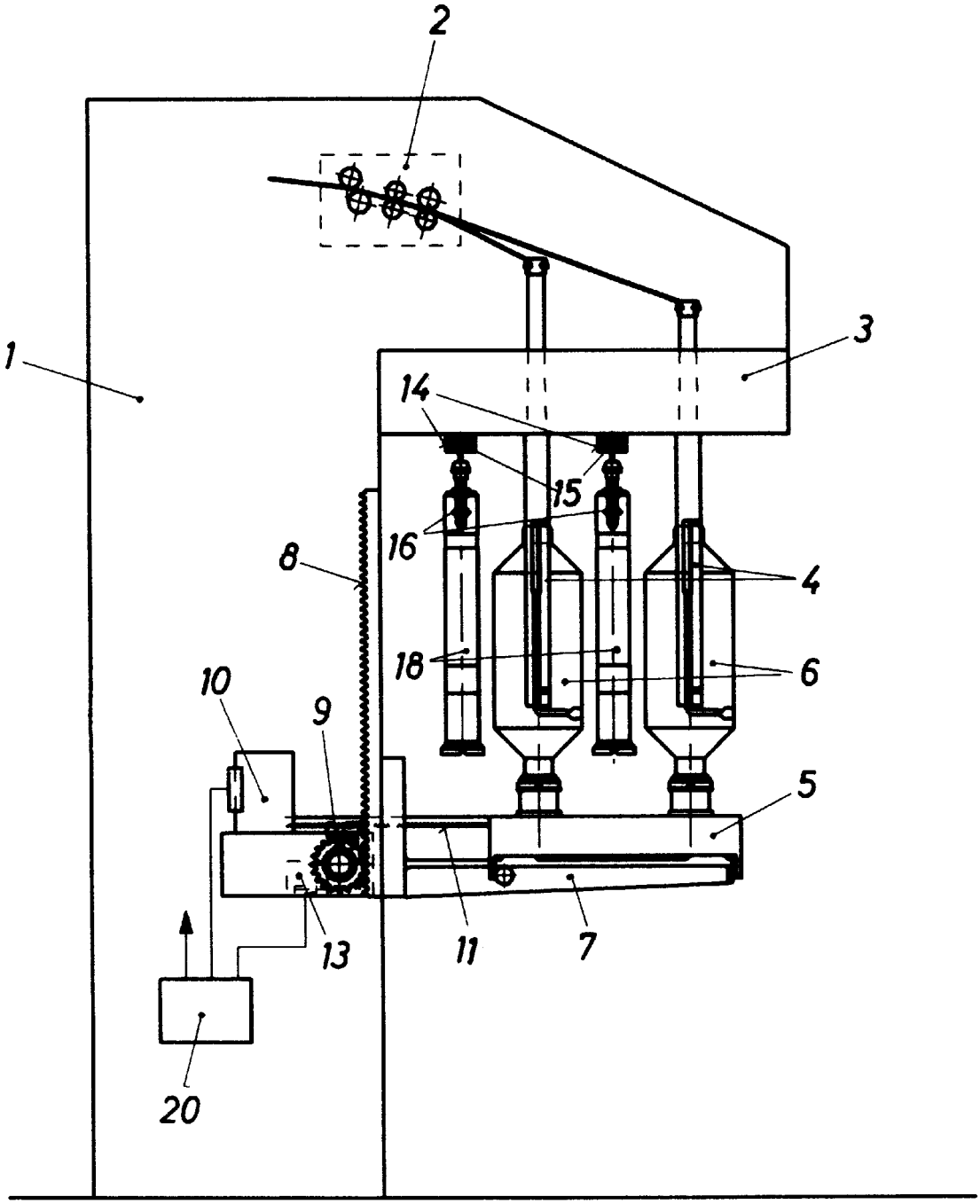
FIGS. 1*a* to 1*i* are cross sectional views through a roving frame of successive phases in the replacement process of a first embodiment; in cross section, through the roving machine.

In the Figures of the drawing only the parts of a roving machine required for an understanding of the present invention have been shown. A machine stand 1 carries a drafting frame 2 and a flyer rail 3 on which flyers 4 arranged in two rows are rotatably journaled. The flyer rail contains the common drive for the flyers not shown in detail. In the machine stand 1, further, a bobbin rail 5 is mounted so as to be displaceable vertically, the bobbins 6 being rotatably journaled therein. The bobbin rail 5 contains the common drive for the bobbins 6 not shown in greater detail.

The bobbin rail 5 is mounted, over the length of the roving frame on a plurality of traverses 7 spaced apart along the length on these traverses 7, racks 8 are vertically arranged and mesh with pinions 9 which are on a common shaft driven by a motor 10 for effecting the up and down movement of the bobbin rail 5. By means of this drive device, the bobbin rail can be moved up and down relative to the flyers to build the turns of the bobbins. In the embodiment of FIGS. 1*a* to 1*i*, the bobbin rail 5 is also shiftable transversely to the longitudinal direction of the roving frame on the traverses 7. It has, for this purpose, preferably at each traverse 7, teeth 11 in which the pinions 12 engage (FIG. 1*e*). These pinions 12 are seated on a common shaft extending over the length of the bobbin rail 5 which is driven by a motor 13 back and forth rotatably.

On the underside of the flyer rail 3, alongside the journal locations of the flyers 4 and their head regions, there are guide tracks 14 in which the suspension trolley trains 15 are displaceable. These suspension trolley trains 15 can be of common construction and can be composed of mutually articulated connected suspension carriages which run via guide and running rolls on or in the guide tracks 14 and for example by means of running rollers travel in or on the guide track 14 and are movable in the guide track 14 by known friction wheel drives composed of friction rollers which can engage the lateral flanks of the suspension carriages. The suspension carriages support suspension hangers 16 on which full roving bobbins 6 or empty roving sleeves 18 are shiftable. In the described embodiment, the suspension carriage train has hanging holders 16 at half the mutual spacing of the flyers 4 and bobbins 6 of the roving machine. The elements of the roving machine which cooperate during the replacement of the bobbins 6 by sleeves 18, like the drive for the flyers, the motor 10 for elevating the bobbin rail 5, the motor 13 or the back and forth shifting of the bobbin rail 5 and the friction wheel drive of the suspension trolley train 15 are connected with one another via a control device 20 which ensures the functional interrelationship of these elements. The line ending in an arrowhead and extending from the control device 20 symbolizes the connection of the control device 20 to other working elements of the ring-spinning machine.

FIG. 1*a* shows the starting position for the replacement of the full bobbins 6 on the bobbin rail 5 of the roving machine by empty sleeves 18. The bobbins 6 are completed, the roving machine is brought into its standstill position in which the arms of the flyers 4 lie in the longitudinal direction of the ring-spinning machine and suspension trolley trains 15 with sleeves 18 are fed into the guide tracks 14. Between the suspension holder 16 fitted with the sleeves 18 are left respective empty hanger holders.

Figure 1B:
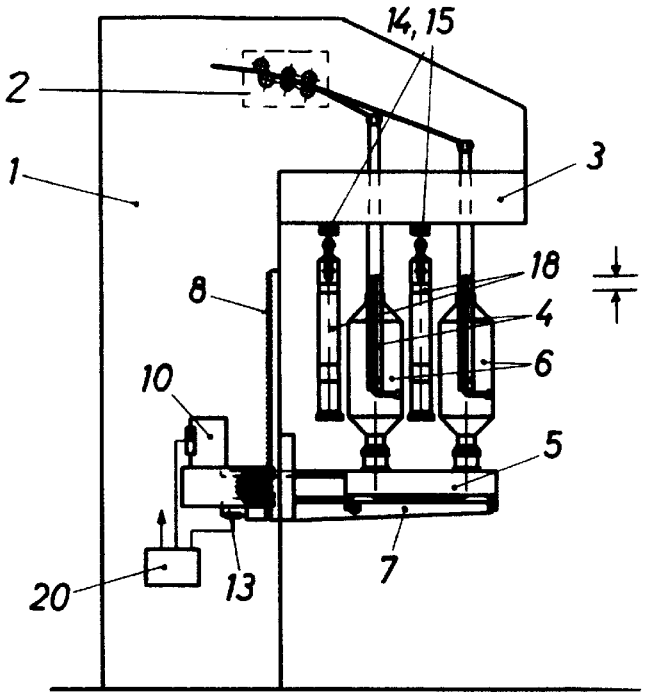
Figure 1C:
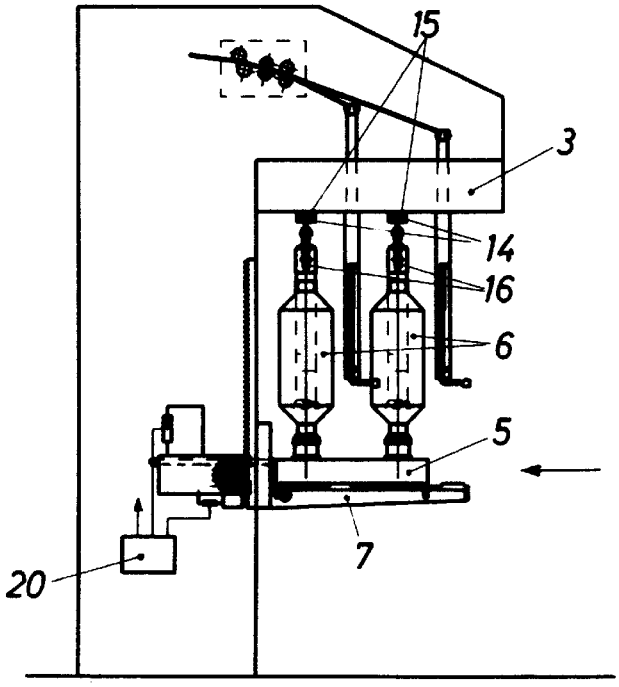
Figure 1D:
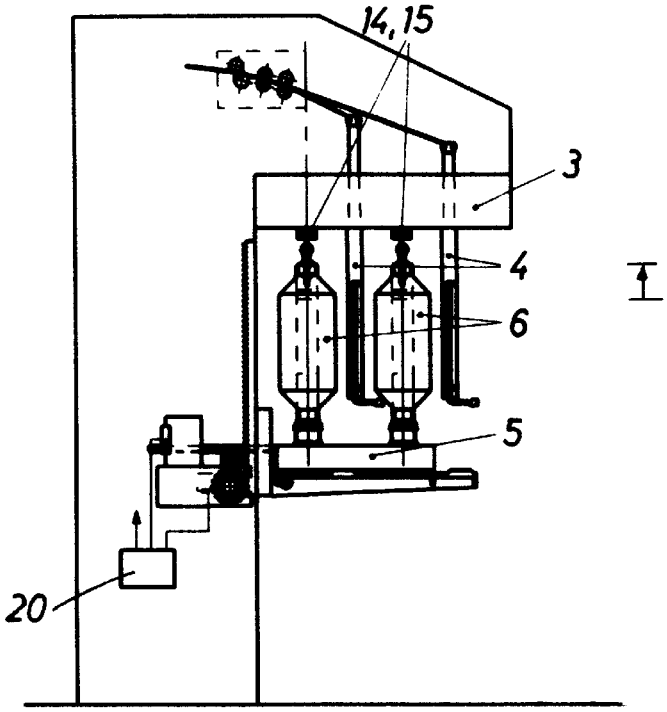
Figure 1E:
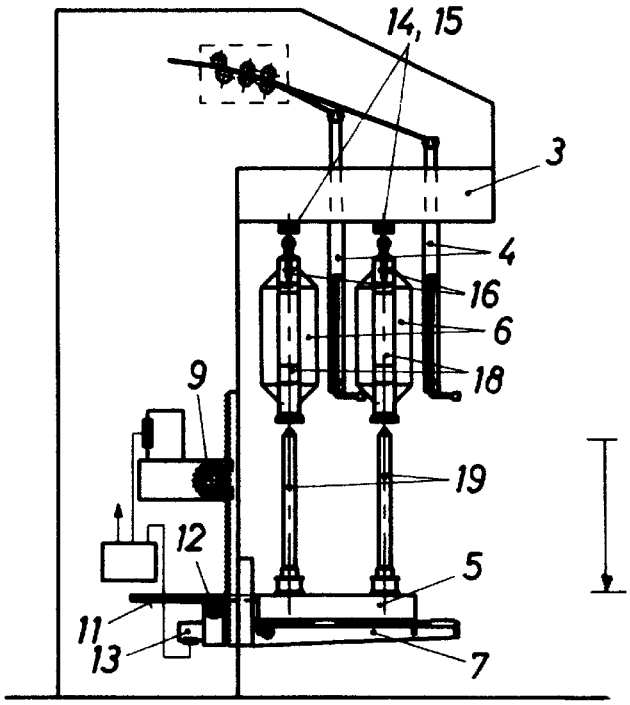

In the next step, according to FIG. 1*b*, the bobbin rail 5, by appropriate control of the motor 10 via the control unit 20, through the pinion 9 and the rack 8 lowers according to the arrows only to the extent that the upper edges of the bobbins 6 are located below the hangers 16. Then, according to FIG. 1*c* and the arrow, in this Figure, the bobbin rail 5 by corresponding control of the motor 13, via the pinion 12 and the teeth 11, is retracted relative to the roving machine so that the bobbins 6 are disposed beneath the empty hangers 16 of the suspension trolley trains. Then the bobbin rail 5 is again raised according to FIG. 1*d* until the bobbins index in these hangers 16. The bobbin rail 5 is then lowered according to FIG. 1*e* sufficiently that the bobbin spindles permit a displacement of the suspension trolley trains 15 until the hangers 16 with the sleeves 18 are brought above the bobbin spindles 19.

Figure 1F:
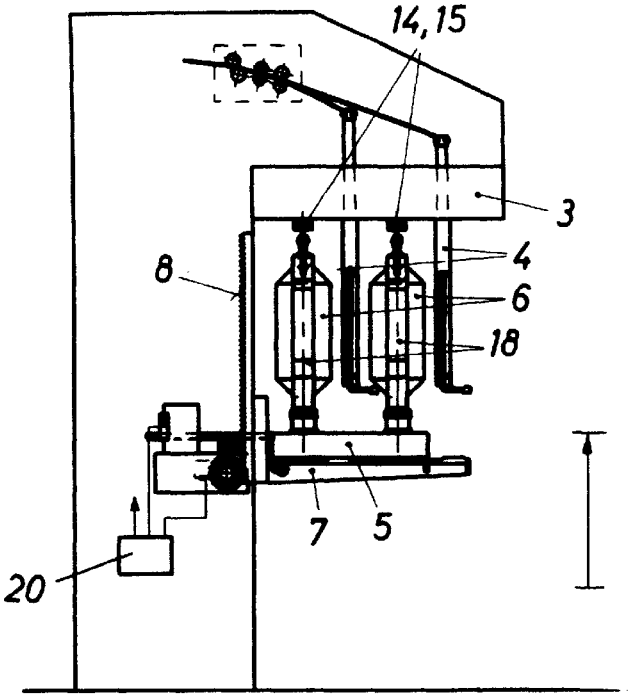
Figure 1G:
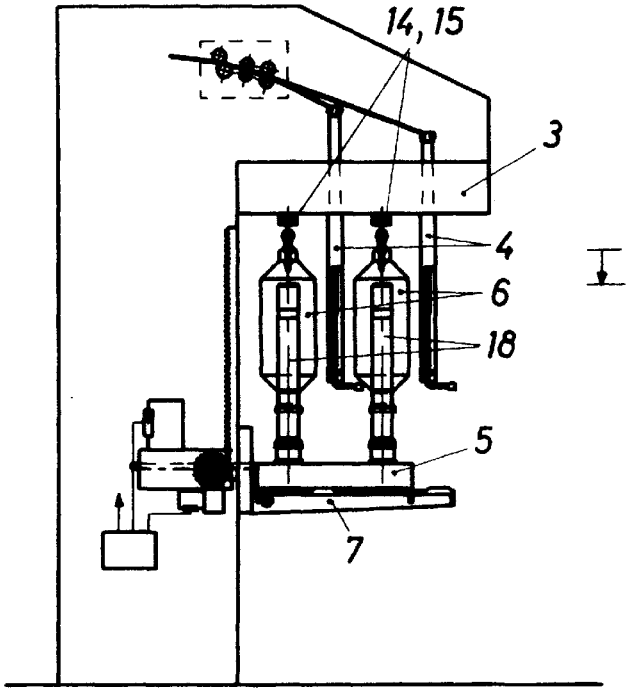
Figure 1H:
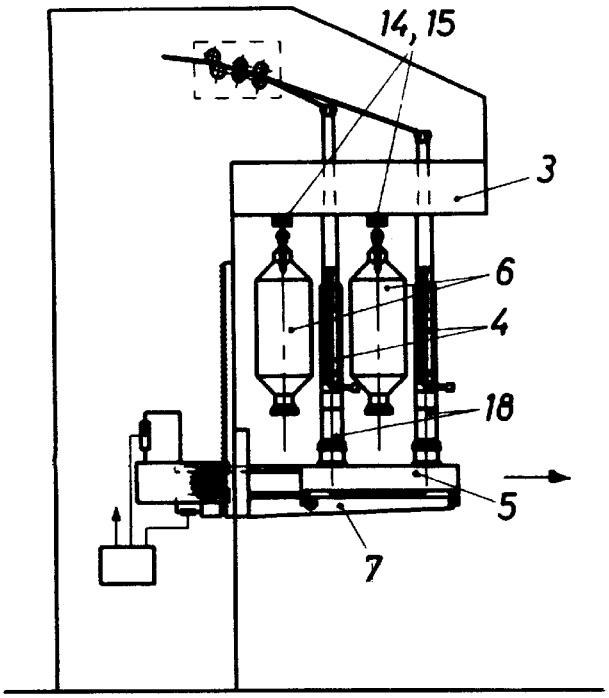
Figure 1I:
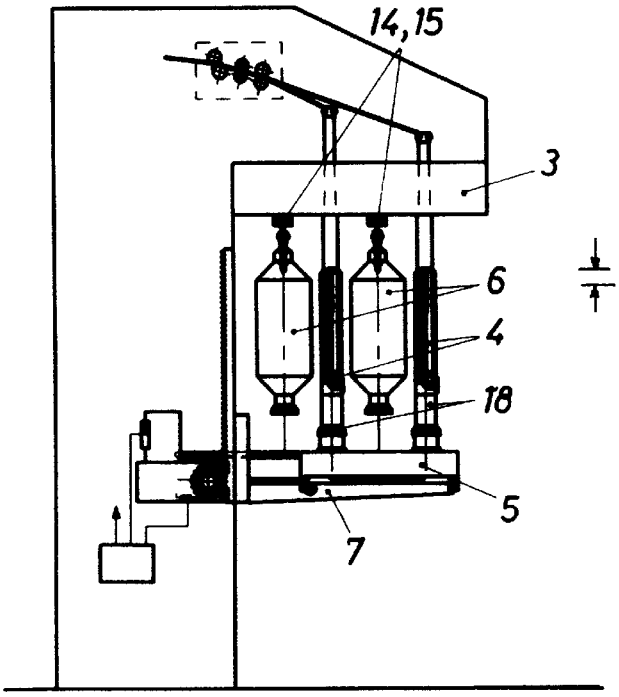

Then the bobbin rail 5 according to FIG. 1*f* is again raised to release the sleeves 18 from the hangers 16 and stick the sleeves on the spindles 19. After lowering (FIG. 1*g*) and forward displacement (FIG. 1*h*) of the bobbin rail 5, the sleeves 18 remain in the flyers 4. By raising (FIG. 1*i*) the bobbin rail 5 the starting position for the restarting of the roving machine is reached. As soon as the suspension trolley train 15 with the bobbins 6 leave the regions of the flyers 4, the roving machine can be operated again.

Figure 2A:
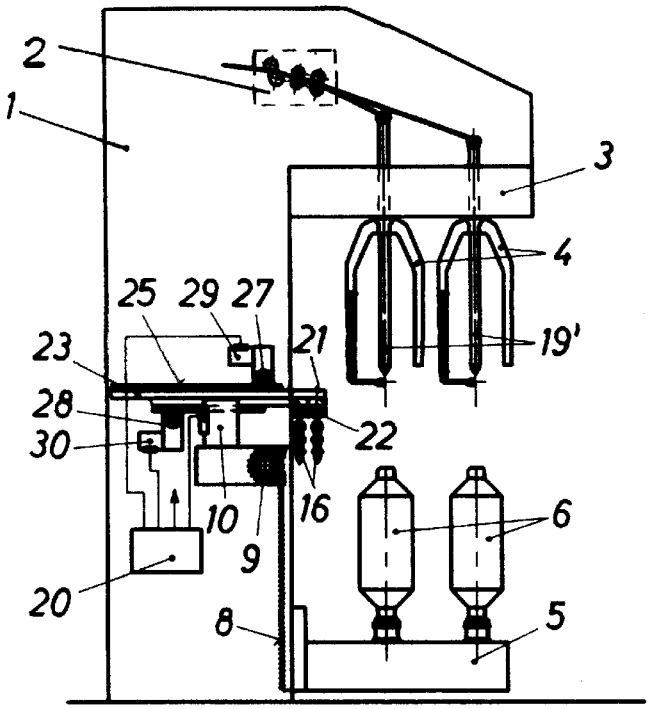
FIGS. 2*a* and 2*b* are similar views of two phases in the replacement in a second embodiment in cross section through the roving machine.
Figure 2B:
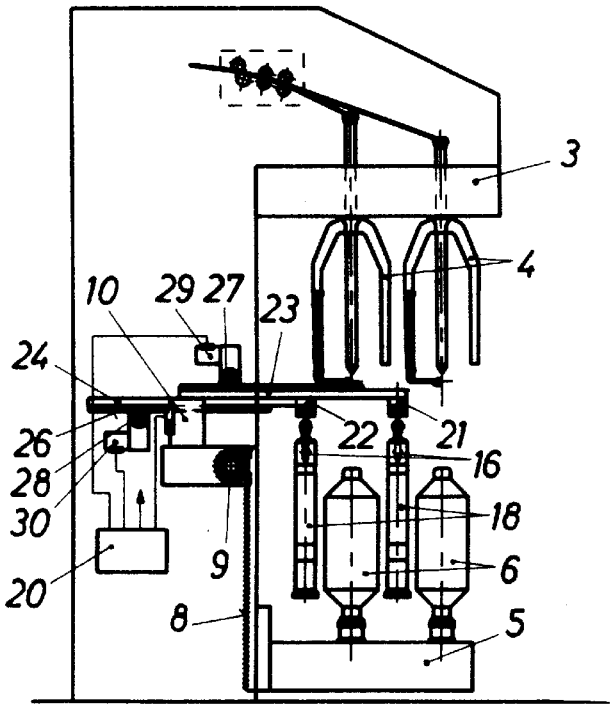

In FIGS. 2*a* and 2*b*, an embodiment is illustrated in which the bobbin rail 5 is not shiftable transversely to the longitudinal axis of the roving machine. The required relative displacement of the guide tracks and the spindle is here present in the shiftability of the guide tracks. Since the guide tracks 14 of FIGS. 1*a* through 1*i* corresponding functionally to the guide tracks 21 and 22 which are movable and can be displaced transversely to the longitudinal direction of the roving machine below the flyers 4 into vertical planes through the flyers, they can be displaced into the planes of the bobbin carriers of the bobbin rail 5. For this purpose, as is especially apparent from FIGS. 4*a* and 4*b*, the guide tracks 21 and 22 can be shiftable by shifting rods 23 and 24 distributed over the length of the guide tracks and movable horizontally forwardly and back. The shifting of the shifting rods 23 and 24 is effected by means of teeth 25, 26 on the shifting rods and pinions 27, 28 engageable in these teeth and which are driven by motors 29, 30. However, also fluidic (pneumatic or hydraulic) working elements can be provided.

Since the two guide tracks 21, 22 must be shiftable by different stretches, they are fastened to shifting rods 23 or 24 displaceable to different degrees back and forth.

Figure 4A:
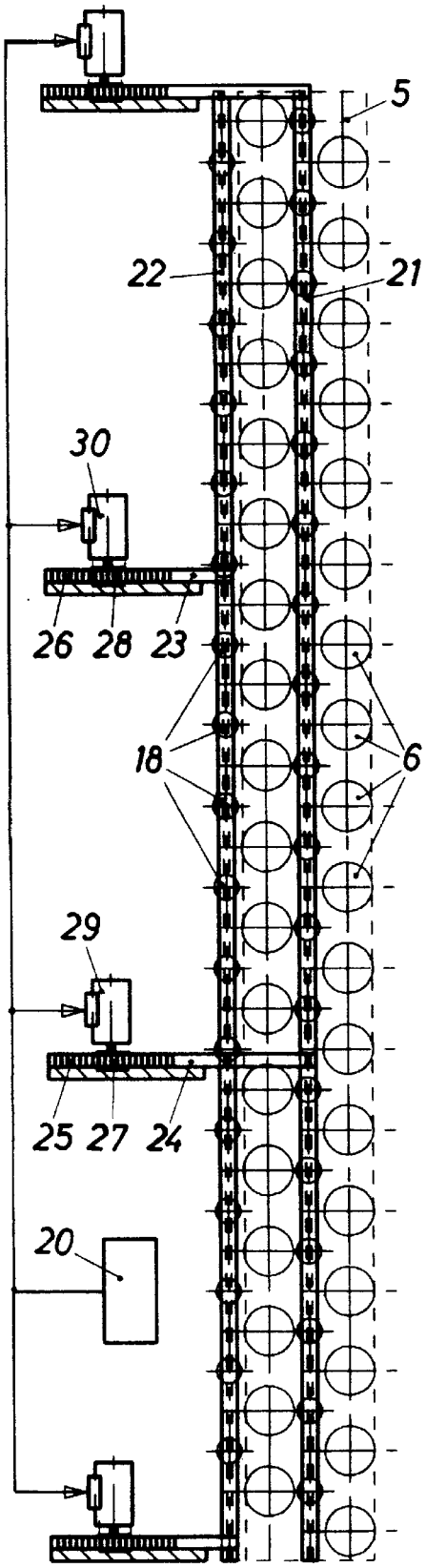
FIGS. 4*a* and 4*b* are plan views showing the two positions of the embodiment of FIGS. 2*a* and 2*b*.
Figure 4B:
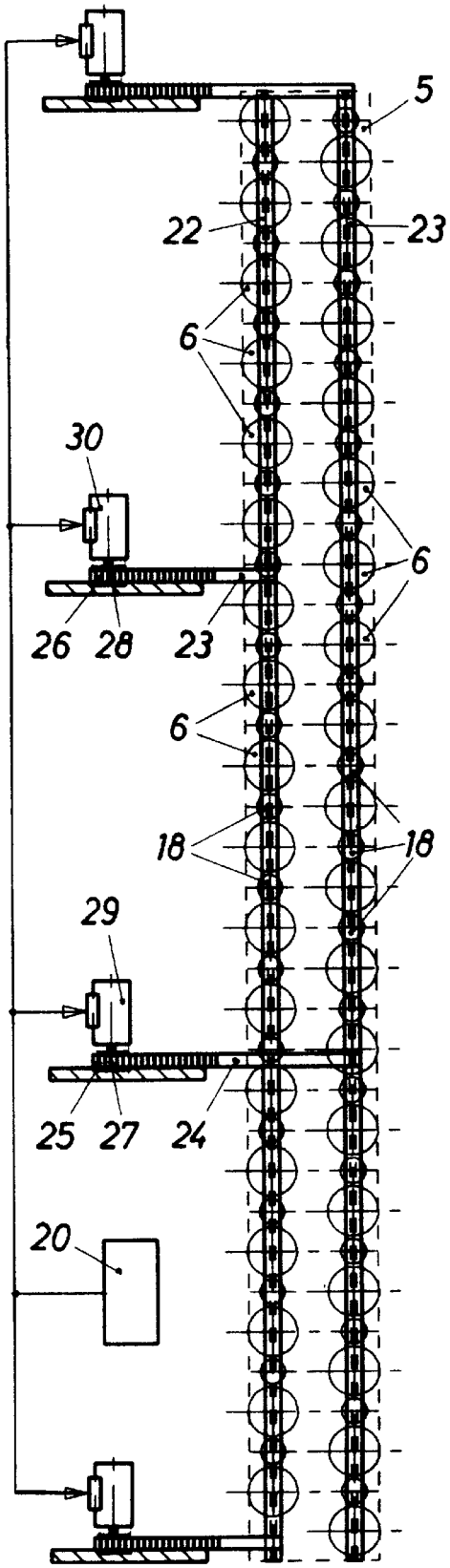

FIG. 2*a* shows the starting position for the change operation: the bobbin rail 5 with the bobbins 6 is lowered, the guide tracks 21, 22 are yet in retracted positions in which they do not inhibit the rotation of the flyers 4 and the vertical movement of the bobbin rail 5. In a first step of FIG. 2*b* by corresponding control of the motors 29, 30 via the pinions 27, 28 and teeth 25, 26, is the bobbin rail 5 shifted to the front sufficiently that the front guide track 21 lies between the rows of the bobbins 6 while the rear guide track 22 lies close behind the rear row of bobbins. In this position the suspension trolley train 15 which is fitted with sleeves 18 is fed into the guide tracks sufficiently that its sleeves lie in the gaps between the bobbins 6 while their sleeves lie in gaps between the bobbins 6 or their empty hangers 16 are adjacent the bobbins: FIG. 4*a*. In the next step shown in FIG. 4*b*, the guide tracks 21 and 22 are shifted further forwardly until the suspension trolley train or its hangers 16 lie in the plane of the flyers 4 and in which the bobbins are disposed. The sleeves 18 hanging from the suspension trolley train 15 lie between the bobbins 6 and stand on the bobbin rail 5 and the hangers 16 which are not visible in FIG. 4*b* are disposed above the bobbins. By properly timed raising and lowering of the bobbin rail 5 and operation of the suspension trolley trains 21 and 22 in a manner similar to that described the bobbins 6 are replaced by the sleeves 18.

Alternatively it is also possible in a nonillustrated pattern of operation of the guide tracks 21, 22 to feed suspension trolley trains in the plane of the flyers 4 and the bobbins which are not equipped with the bobbin sleeves so that the bobbins can be hung on these trolley trains, the suspension trolley trains carrying the bobbins are fed out, suspension trolley trains on which sleeves are mounted can be fed in and the bobbins transferred to the bobbin rail and the suspension trolley trains from which the bobbins are removed, further displaced out of the region of the flyers before the guide tracks are retracted and the bobbin rail lifted for further running of the roving machine.

Figure 3A:
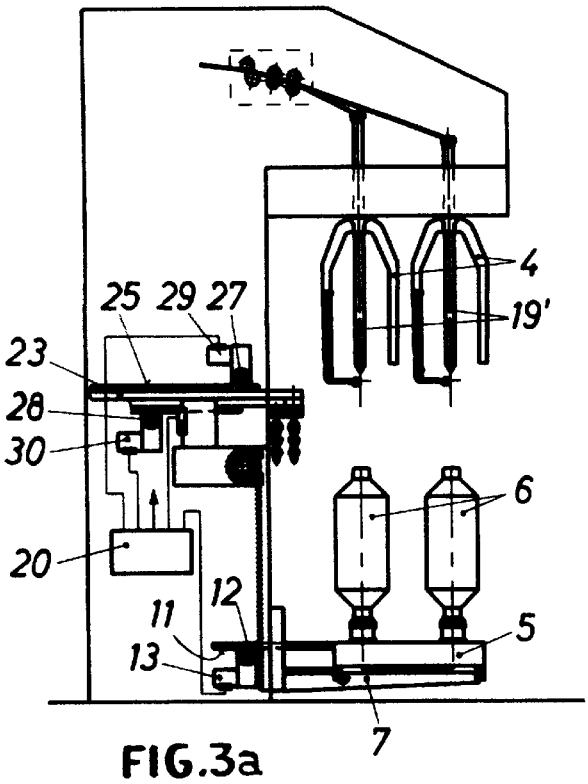
FIGS. 3*a* to 3*e* are cross sectional views of successive phrases of another embodiment.
Figure 3B:
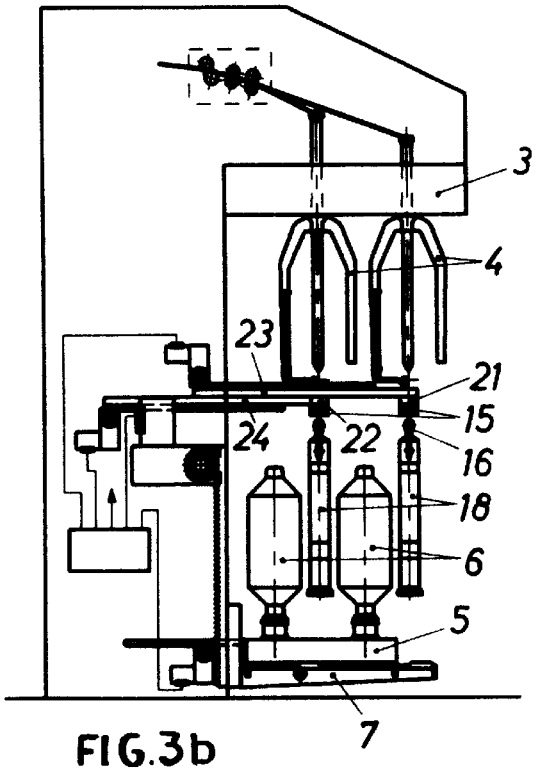
Figure 3C:
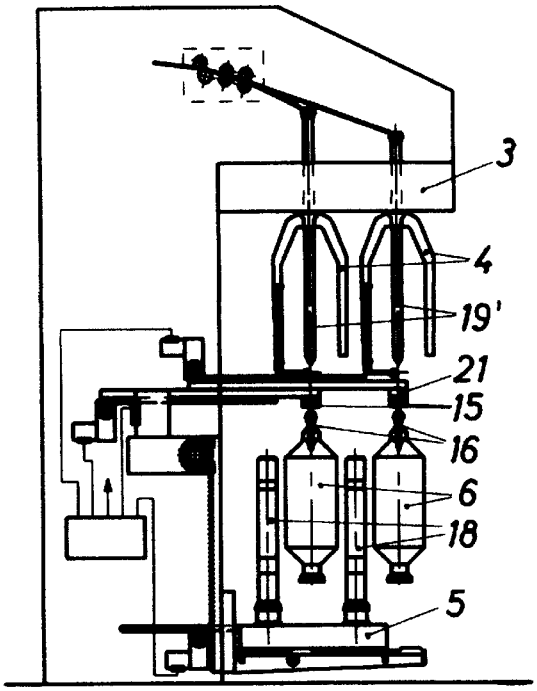

FIGS. 3*a* to 3*e* show an embodiment in which both the bobbin rail 5 and also the guide tracks 21 and 22 located below the flyers 4 are shiftable forward and back, as already described. For the exchange, the guide tracks 21 and 22, after lowering and retraction of the bobbin rail 5 from its starting position shown in FIG. 3*a* is displaced by means of the motors 29 and 30 via the pinions 27 and 28 and the toothing 25 and 26 to different extents forwardly between the rows of the lowered bobbins 6. This position lies in the vertical planes of the flyers 4. Then the suspension trolley trains 15 equipped with sleeves 18 can be fed in to the extent that their sleeves lie in gaps between bobbins 6 or their empty hangers 16 while adjacent the bobbins: FIG. 3*b*. The empty hangers 16 and the bobbins 6 are located one above the other, the guide rails being shiftable transversely to the longitudinal direction of the machine.

Figure 3D:
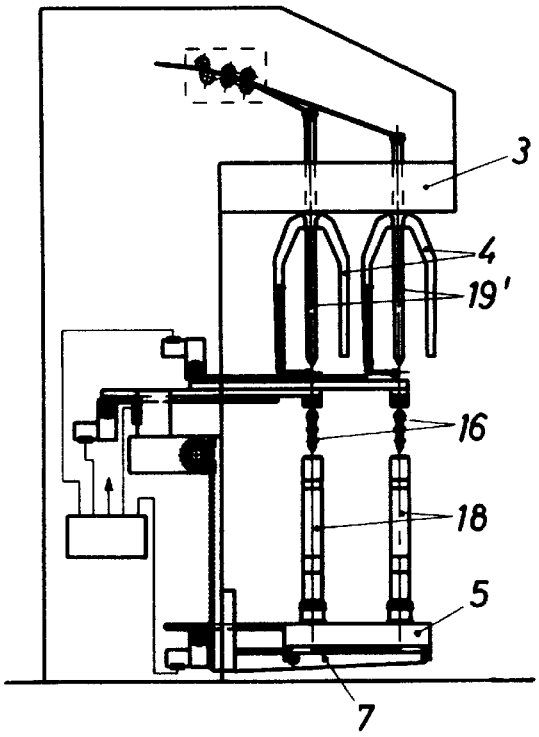
Figure 3E:
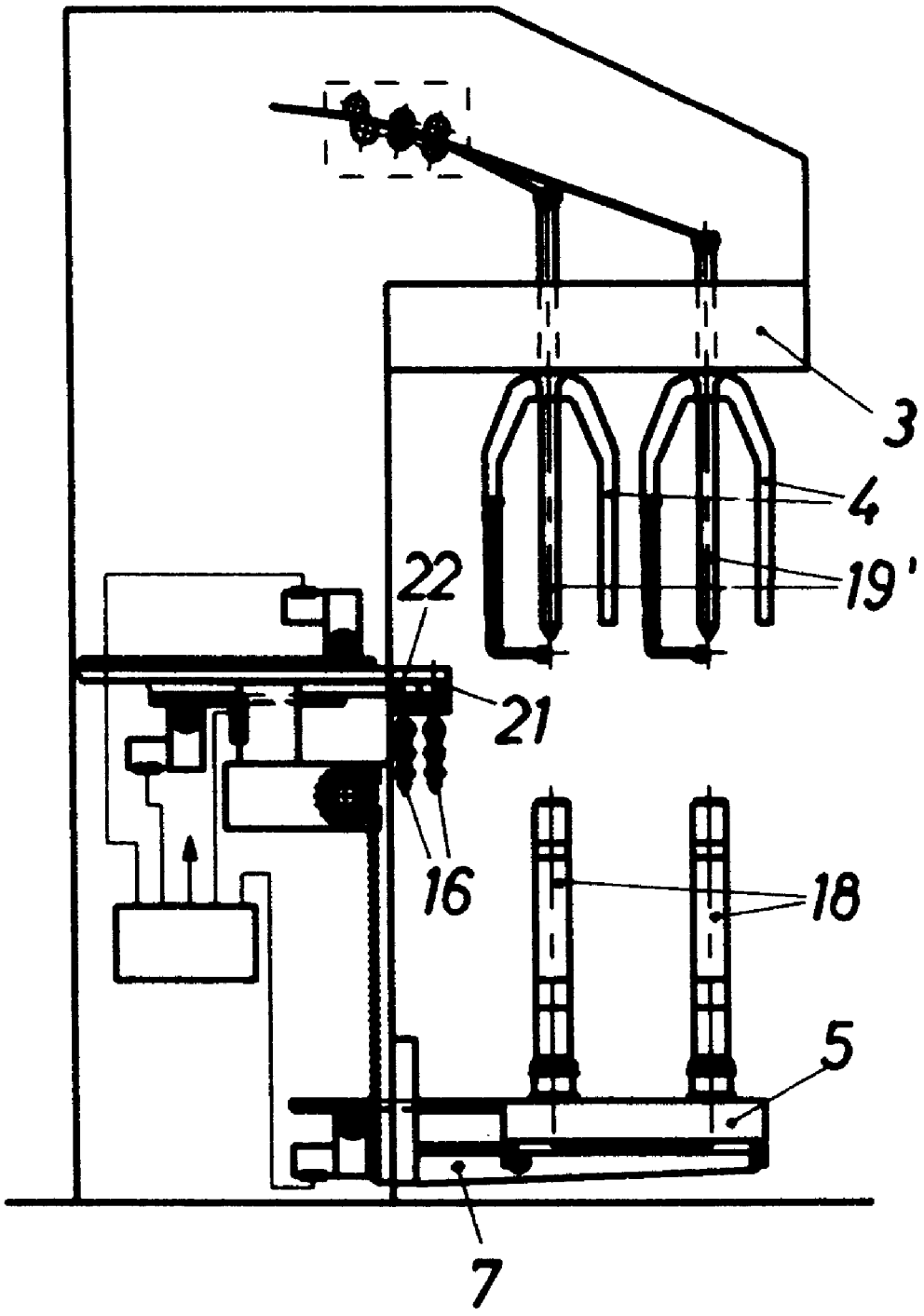

When this has occurred, by corresponding lifting and lowering of the bobbin rail 5, the bobbins 6 are latched into the hangers 16 and thereby transferred to the suspension trolley trains 15 (FIG. 3*c*) and after displacement of the suspension trolley trains by the spacing of the hangers, a renewed lifting and lowering of the bobbin rail 5 is carried out to unlatch the sleeves 18 from the hangers 16 and transfer them to the bobbin rail: FIG. 3*d*.

After the suspension trolley train 15 has been fed out of the roving machine, the guide tracks 21 and 22 are withdrawn into their rest positions (FIG. 3*e*), whereupon the bobbin rail 5 can be raised into its starting position for the spinning.

The distance of the guide tracks in the retracted position can be so dimensioned that in this position suspension trolley trains 15 already fitted with sleeves 18 can be introduced.

In a manner not shown in detail, the guide tracks 21 and 22 can be also swingably mounted for pivoting about axes parallel to the longitudinal direction of the roving machine. The sequence in the exchange process then corresponds to that which has been described.

In the embodiment with guide tracks 21 and 22 which can be introduced below the flyers 4, the spindles 19' which receive the bobbins can advantageously be mounted on the flyers 4 because otherwise the bobbin rail 5 must be lowered sufficiently or the flyer rail must be raised sufficiently to enable the bobbins 6 and sleeves 18 suspended from the suspension trolley trains 15 to pass above the bobbin spindles on the bobbin rail.

We claim:

1. A roving machine comprising:

a flyer rail provided with two rows of flyers;

a bobbin rail below said flyer rail and having bobbin carriers for receiving bobbin sleeves receivable within respective flyers and upon which bobbins are wound; and a bobbin change device for automatic replacement of full bobbins with empty sleeves, said bobbin change device comprising:

a guide track extending along each of said rows of flyers on said flyer rail at a level substantially of heads of said flyers outside of said flyers and laterally spaced from the respective row of flyers so that said tracks alternate with said rows of flyers at said level, a suspension carriage train displaceable along said track and having spaced apart hangers for receiving full bobbins and supplying said empty sleeves, means for relatively transversely shifting said bobbin rail and said guide track to align said hangers and said bobbin carriers in a common vertical plane, and means for relatively vertically shifting said bobbin rail and said guide track to suspend full bobbins from said bobbin rail on said hangers and transfer empty sleeves from said hangers to said bobbin carriers.

2. The roving machine defined in claim 1 wherein said means for relatively transversely shifting said bobbin rail and said guide track includes means for shifting said bobbin rail back and forth.

3. The roving machine defined in claim 2 wherein said bobbin carriers are spindles.

4. A roving machine comprising:

a flyer rail provided with at least one row of flyers;

a bobbin rail below said flyer rail and having bobbin carriers for receiving bobbin sleeves receivable within respective flyers and upon which bobbins are wound; and a bobbin change device for automatic replacement of full bobbins with empty sleeves, said bobbin change device comprising:

a guide track extending along said row of flyers at a level substantially immediately below bottoms of said flyers and laterally spaced from said flyers, a suspension carriage train displaceable along said track and having spaced apart hangers for receiving full bobbins and supplying said empty sleeves, means for relatively transversely shifting said bobbin rail and said guide track to align said hangers and said bobbin carriers in a common vertical plane, and means for relatively vertically shifting said bobbin rail and said guide track to suspend full bobbins from said bobbin rail on said hangers and transfer empty sleeves from said hangers to said bobbin carriers.

5. The roving machine defined in claim 4 wherein said flyers are provided with flyer spindles to receive said bobbin sleeves.

6. The roving machine defined in claim 4 wherein said means for relatively transversely shifting said bobbin rail and said guide track includes means for shifting said guide track.

* * * * *